United States Patent [19]

Goto et al.

[11] 4,125,647

[45] Nov. 14, 1978

[54] METHOD OF PRODUCING ONE-SIDE PLATED STEEL SHEETS OR STRIPS

[75] Inventors: Minari Goto; Hideo Komura, both of Chiba, Japan

[73] Assignee: Kawasaki Steel Corporation, Kobe, Japan

[21] Appl. No.: 800,294

[22] Filed: May 25, 1977

[30] Foreign Application Priority Data

Jun. 1, 1976 [JP] Japan ..... 51-63942

[51] Int. Cl.[2] ..... C23C 1/02; C23C 1/08

[52] U.S. Cl. ..... 427/300; 427/320; 427/321; 427/353; 427/431; 427/433; 148/14

[58] Field of Search ..... 427/300, 329, 282, 259, 427/320, 321, 353, 431, 433; 228/214, 215

[56] References Cited

U.S. PATENT DOCUMENTS

| | | | |
|---|---|---|---|
| 3,089,780 | 5/1963 | Siple | 427/300 |
| 3,104,993 | 9/1963 | Sievert | 427/300 X |
| 3,149,987 | 9/1964 | Crandall | 427/300 |
| 3,177,085 | 4/1965 | Adams | 427/300 |
| 3,181,963 | 5/1965 | Cook et al. | 427/300 |
| 3,398,010 | 8/1968 | Harvey et al. | 427/300 |

*Primary Examiner*—Ralph S. Kendall

[57] ABSTRACT

Anti-plating agents which form, after heated, compounds having a composition of $$(0.5\text{–}9.0)M_2O.SiO_2.(0.1\text{–}(0.1\text{–}7.2)B_2O_3.(1.0\text{–}34.5)\text{-}MgO$$

wherein M represents an alkali metal, are disclosed. An anti-plating film formed on the surface of a steel sheet by the use of the agent is excellent in the property for preventing the sheet from being plated and in the peeling property from the sheet, and the agents are suitable for production of one-side hot-dip plated steel sheets.

8 Claims, 1 Drawing Figure

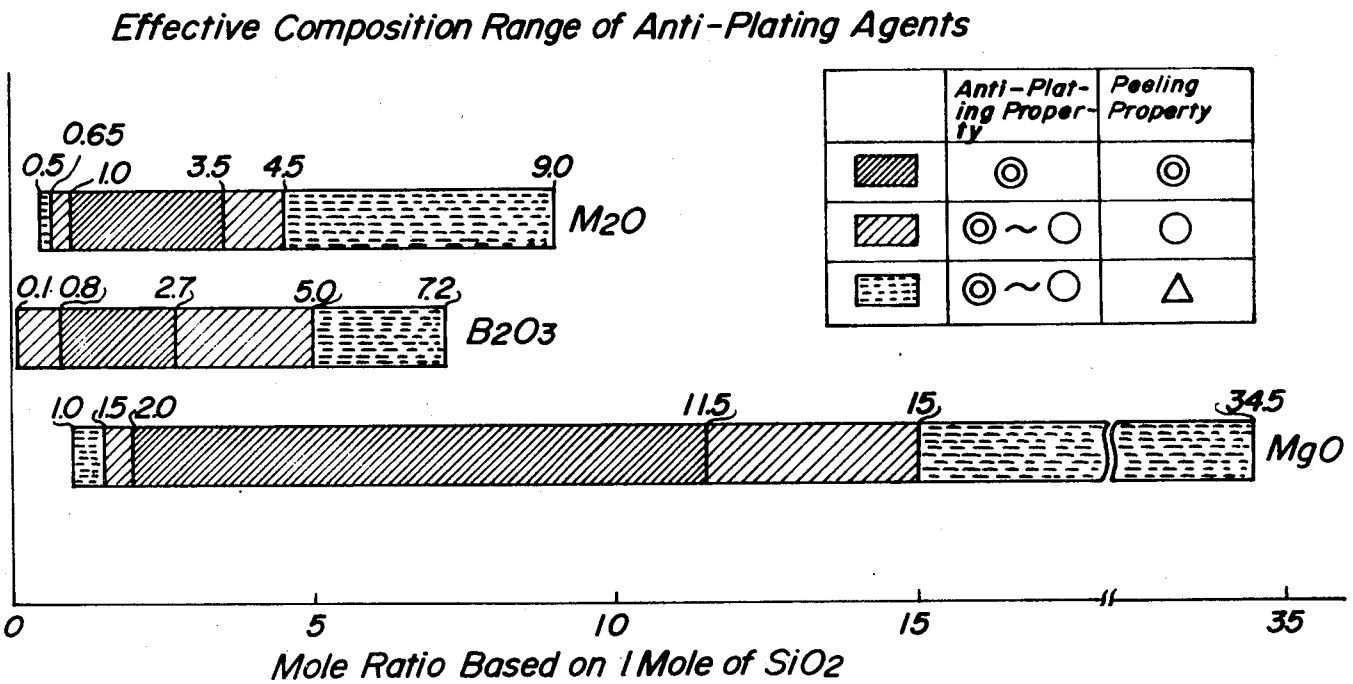
Effective Composition Range of Anti-Plating Agents
Anti-Plating Property
Peeling Property
M2O
B2O3
MgO
0.5
0.65
1.0
3.5
4.5
9.0
0.1
0.8
2.7
5.0
7.2
1.0
1.5
2.0
11.5
15
34.5
0
5
10
15
35
Mole Ratio Based on 1 Mole of SiO2

METHOD OF PRODUCING ONE-SIDE PLATED STEEL SHEETS OR STRIPS

The present invention relates to a method of producing one-side plated steel sheets or strips by a hot-dip process.

Recently, in the field of the steel sheet to be used for automobile, domestic electrical equipment, building material and the like, it has been eagerly demanded to produce a so-called one-side plated steel sheet by plating only one side of a steel sheet to give the sheet a sufficiently high corrosion resistance and at the same time to improve the weldability of the sheet.

The present invention aims to provide a method of producing easily and inexpensively such one-side plated steel sheet.

One-side plated steel sheet can be produced by the electroplating process, but the electroplating process is low in the plating speed and high in the production cost of the sheet. Therefore, the hot-dip process is advantageously used in the production of one-side plated steel sheet on a large scale.

There have hitherto been proposed various methods in the production of one-side plated steel sheet by the hot-dipping process. For example, the following methods have been known in the production of zinc-plated steel sheet, that is, a method, wherein two steel sheets are superposed and welded at the edge, and the welded steel sheets are plated, and then the welded edge is cut off; a method, wherein molten zinc is plated only one-side of a steel sheet by the roll coating method, curtain flow coating method or other particular method; a method, wherein molten zinc is plated to both surfaces of a steel sheet in different thicknesses, and zinc film having a smaller thickness is removed by dipping the plated sheet in acid or by electrolysis; a method, wherein an anti-plating agent is previously coated on only one side of a steel sheet, the sheet is plated, and then the film of the anti-plating agent is removed; and the like.

However, in these methods, the production of one-side plated steel sheet is technically difficult and the production cost of the sheet is high. Therefore, there has seldomly been succeeded in the commercial production of one-side plated steel sheet by the above described methods.

The present invention relates to an improvement of the above described method using anti-plating agent. As the conventional one-side zinc-plating methods by the use of anti-plating agent, the following technics have been known. For example, Japanese Patent Application Publication No. 7,112/64 and Society of Automotive Engineers, Automotive Engineering Congress, Detroit, Mich, January 11–15, 1971 (A. F. Prust, Manufacture of Hot-Dipped One-Side Galvanize) disclose the use of water-glass, Japanese Patent Application Publication No. 4,204/64 discloses the use of an aqueous slurry of a mixture of CaO, MgO and alkali metaborate, U.S. Pat. No. 3,121,019 discloses the use of alkaline earth metal hydroxide, and U.S. Pat. No. 3,149,987 discloses the use of an aqueous slurry of pulverized bentonite ore.

However, these methods still have the following drawbacks. That is, in the continuous hot-dip metal-plating process, wherein a steel sheet with anti-plating film coated thereon is annealed (usually at about 700° C) just before a metal is plated to the sheet by hot-dipping, the anti-plating film coated on a steel sheet surface decomposes or partly exfoliates from the steel sheet surface during the annealing. Therefore, it is difficult to prevent completely one side of the steel sheet from being plated. Moreover, the steel sheet is sometimes oxidized in the air after plating, and a troublesome step is required in order to reduce or mechanically remove the oxide. Further, the film formed on one side of steel sheet by a coating agent is generally poor in the peeling property, and it is almost impossible to remove completely the film without deteriorating the appearance of steel sheet surface. In addition, the removal of the film is expensive.

The present invention provides a method of producing one-side plated steel sheets, wherein the above described drawbacks are eliminated by the use of a novel anti-plating agent.

The inventors have made various investigations in order to overcome the drawbacks of conventional methods, and found that it is effective to use an anti-plating agent, which forms a crystalline or amorphous film consisting of four components of $SiO_2$, $B_2O_3$, MgO and $M_2O$, wherein M represents an alkali metal.

In the anti-plating agent, as the $SiO_2$ component, alkali silicate ($M_2O.nSiO_2.mH_2O$) can be used; as the $B_2O_3$ component, boric acid ($H_3BO_3$), boric anhydride ($B_2O_3$) or sodium borate ($Na_2B_4O_7$) can be used; as the MgO component, magnesium oxide (MgO) or magnesium hydroxide ($Mg(OH)_2$) can be used; and as the $M_2O$ component, sodium hydroxide (NaOH), lithium hydroxide (LiOH) or potassium hydroxide (KOH) can be used. These compounds are added to proper amount of water and used. Of course, the above described $M_2O$ component can be partly or wholly replaced by the $M_2O$ component of alkali silicate or $Na_2O$ component of sodium borate. Among alkali silicates, water-glass ($Na_2O.nSiO.mH_2O$, $2 \leqq n \leqq 4$) is inexpensive. As the alkali, NaOH is inexpensive.

It has been found that the above described four components are essential and that, when any one of them is not present, satisfactory one-side plated steel sheets cannot be obtained. The inventors have succeeded in the production of one-side plated steel sheets without troubles inevitable in the above described conventional technics by a method, wherein an aqueous slurry containing the above described four components is coated to only one side of a steel sheet and the steel sheet is annealed at a temperature (usually at about 700° C) of not lower than the recrystallization temperature of the steel sheet and immediately passed through a molten metal-containing plating bath in the same manner as that of commonly known continuous hot-dip metal-plating process to plate only that side of the steel sheet which is not coated with the film of the anti-plating agent, and then the film is removed from the steel sheet surface.

In the present invention, an aqueous slurry having the above described composition is coated on one side of a sufficiently degreased steel sheet, and dried at low temperature, preferably at a temperature of not higher than about 200° C. The coating can be effected by any one of roll coating, spray coating, brush coating or other optional methods. The proper amount of the aqueous slurry to be coated is 20–150 g/m$^2$ in dry weight. When the coating amount is smaller than 20 g/m$^2$, the coating slurry film cannot completely cover the steel sheet surface. While, when the coating amount is larger than 150 g/m$^2$, cracks are apt to occur in the coating slurry film during the drying of the film. Therefore, the resulting film cannot prevent completely the coated side of the steel sheet from being plated.

The water contained in the coated slurry film is evaporated by a low-temperature drying. This low-temperature drying is a necessary step in order that the atmosphere in the following annealing step is kept to a reducing atmosphere and that the breakage and exfoliation of the coating film due to rapid heating up to high temperature are prevented.

After the dried uniform film is formed on one-side of the steel sheet, the steel sheet is annealed at a temperature (usually at about 700° C) of not lower than the recrystallization temperature of the steel sheet, cooled to a temperature, which is near the plating bath temperature (in the zinc plating, about 460° C), and dipped in the plating bath in the same manner as that of commonly known continuous hot-dip plating process.

During the annealing, the coating film is partly or wholly formed into vitreous to form a dense film on the steel sheet surface, and the dense film prevents effectively the contact of the steel sheet surface with the molten metal.

The steel sheet brought up from the plating bath is plated at its one side only, and another side of the sheet is covered with the film of the anti-plating agent without plated.

The film is poor in the wettability with the molten metal-containing plating bath. Therefore, plating metal does not substantially adhere to the film. However, when the bringing-up speed of plated steel sheet from the plating bath is high and the cooling speed thereof is high, plating metal is solidified on the film during the interval of time, at which the plating metal flows down along the surface of the film, and adheres physically to the film. Therefore, in order to prevent the adhesion of plating metal to the film, it is preferable to bring up the plated steel sheet at low speed or to wipe the plating metal just after the plating by injecting high-pressure gas heated up to a temperature higher than the melting temperature of the plating metal. However, even when plating metal is adhered to the film, the film prevents completely the contact of steel sheet with the plating metal, and therefore the anti-plating effect of the film does not at all deteriorate.

Moreover, it has been found that, since the film is very dense, the film has a very important role to prevent completely the steel sheet from being oxidized by air after the steel sheet is brought up from the plating bath.

After the plating, the film must be removed. However, it has been found that the film can be easily removed by quenching the plated steel sheet, after the sheet is brought up from the plating bath, from a temperature of not lower than about 100° C to room temperature.

The quenching may be carried out before the plating metal is solidified in order to regulate simultaneously the spangle size or after the plating metal is solidified. Alternatively, after a plated steel sheet may be once cooled gradually, the sheet may be again heated at any convenient time and then quenched.

The quenching is easily and effectively carried out by immersing the plated steel sheet in water. It has been found as the result of experiments that, when the plated steel sheet is quenched in water, the film can be completely peeled off from the steel sheet surface without changing the original cold rolled surface thereof.

Further, the film can be easily peeled off and removed from the steel sheet surface by bending repeatedly by means of a roll having a radius of curvature of not larger than about 100 mm after the plated steel sheet is gradually cooled to a temperature of not higher than about 100° C. Of course, the film can be removed by commonly known mechanical means, such as grinding, shot blasting and the like. After the film is peeled off from the steel sheet by the water quenching or other means, the plated steel sheet is finally cleaned by water washing and mild brushing, and then dried to obtain a complete one-side plated steel sheet.

According to the present invention, the anti-plating property and peeling property of anti-plating film, which are very poor in the conventional films, are remarkably improved, and complete one-side plated steel sheets can be easily obtained.

The inventors have made various experiments and investigations and found that the above described two important properties vary greatly depending upon the ratio of the four components contained in the above described anti-plating film.

The method and result of the experiments will be explained with reference to continuous hot-dip galvanizing process.

Aqueous slurries of the anti-plating agent used in the experiments, which have a viscosity of about 27 poises, were prepared by dissolving or dispersing predetermined amounts of water-glass ($Na_2O.2SiO_2.8.3H_2O$), $H_3BO_3$, MgO and NaOH in a proper amount of water. When the anti-plating agent is dehydrated and heated, the agent is finally represented by the chemical formula (not the structural formula) of $pNa_2O.qSiO_2.rB_2O_3.sMgO$, wherein *p, q, r* and *s* represent numbers of moles of $Na_2O$, $SiO_2$, $B_2O_3$ and MgO, respectively.

Aqueous slurries of anti-plating agents having various numbers of moles or mole ratios of (*p:q:r:s*) were prepared, and each of the aqueous slurries was coated on one side of a degreased cold rolled steel sheet having a thickness of 0.8 mm by means of a roll coater in an amount that the weight of the slurry after dried was about 50 g/m$^2$.

After the coating, the steel sheet, under an atmosphere of 90% $N_2$ + 10% $H_2$, was heated up to 700° C at a temperature rising rate of 30° C/sec, kept at 700° C for 10 seconds, cooled to about 500° C and successively dipped in a molten zinc-containing plating bath having a composition of 99.82% Zn – 0.18% Al and kept at a temperature of 465 ± 5° C for 3 seconds.

After the plating, the steel sheet was brought up from the plating bath, and the amount of plating metal was regulated just above the plating bath by means of a nitrogen gas wiper. Successively, when the temperature of the steel sheet lowered to about 300° C, the steel sheet was quenched by dipping it in water kept at about 20° C. After the quenching, the surface of the steel sheet was observed, whereby the anti-plating property and peeling property of the resulting anti-plating film were estimated. Further, it has been found that an anti-plating film having more excellent peeling property by quenching is also excellent in its peeling property when tested by mechanical means, such as repeating bending and the like.

In the present invention, the anti-plating property and peeling property of the anti-plating film were estimated by the following standard.

| Estimation | Anti-plating property (Percentage of anit-plated area S, (%) | Peeling property (Percentage of peeled area S', (%) |
|---|---|---|
| ◎ | $S = 100$ | $S' = 100$ |
| O | $97 \leqq S < 100$ | $90 \leqq S' < 100$ |
| Δ | $90 \leqq S < 97$ | $70 \leqq S' < 90$ |
| × | $S < 90$ | $S' < 70$ |

The single FIGURE of the accompanying drawing is a graph showing the effective composition range of the anti-plating agent according to the present invention, and shows the result of the above experiments.

As seen from the FIGURE, the composition range of anti-plating agent effective for its anti-plating property and peeling property is as follows. $M_2O$ is 0.5–9.0 moles, $B_2O_3$ is 0.1–7.2 moles and MgO is 1.0–34.5 moles based on 1 mole of $SiO_2$; preferably, $M_2O$ is 0.65–4.5 moles, $B_2O_3$ is 0.1–5.0 moles and MgO is 1.5–15 moles based on 1.0 mole of $SiO_2$; and more preferably, $M_2O$ is 1.0–3.5 moles, $B_2O_3$ is 0.8–2.7 moles and MgO is 2.0–11.5 moles based on 1.0 mole of $SiO_2$.

In the above experiments, Li and K also exhibited the same effect as that of Na.

The following examples are given for the purpose of illustration of this invention and are not intended as limitations thereof.

EXAMPLE 1

Eighty grams of $Na_2O.2SiO_2.8.3H_2O$, 62 g of $H_3BO_3$, 100 g of MgO and 43 g of NaOH were dissolved or dispersed in a proper amount of water to prepare an aqueous slurry of an anti-plating agent having a composition of $Na_2O:SiO_2:B_2O_3:MgO = 1.63:1:1.04:5.17$ (in mole ratio).

The aqueous slurry was uniformly coated on one-side of a cold rolled common steel sheet having a thickness of 0.8 mm, which had previously been cleaned by alkali degreasing and water rinse, by means of a roll coater in an amount that the weight of the slurry after dried was about 50 g/m$^2$.

After the coating, the steel sheet was heated up to 700° C at a temperature raising rate 30° C/sec under nitrogen atmosphere, annealed at 700° C for 10 seconds under 90% $N_2$ + 10% $H_2$ atmosphere and cooled to about 500° C under the same atmosphere continuously, and then the steel sheet was dipped in a molten zinc-containing plating bath having a composition of 99.82% Zn – 0.18% Al and kept at a temperature of 465 ± 5° C for 3 seconds.

After the plating, the steel sheet was brought up from the plating bath, and the amount of the plating metal was regulated just above the plating bath by means of a superheated steam wiper kept at 450° C. Successively, when the temperature of the steel sheet lowered to about 300° C, the steel sheet was quenched by dipping it in water kept at about 20° C.

In the above plated steel sheet, one side of the steel sheet was plated with zinc and another side thereof was completely coated with the film of the anti-plating agent. However, the film was completely peeled off from the steel sheet surface in a percentage of peeled area of 100%.

Further, the plated steel sheet, without effecting the above described quenching in water, was left to stand in the air to be cooled to a temperature of not higher than 100° C, and the cooled steel sheet was subjected to five times of repeated bendings by means of a roll bender having a radius of curvature of 100 mm. In the repeated bending also, the anti-plating film was completely peeled off from the steel sheet surface in a percentage of peeled area of 100%.

After the anti-plating film was peeled off from the steel sheet surface by the above described water quenching or repeated bending, the steel sheet surface was subjected to a mild final polishing by means of a polishing roll (Scotch bright roll), washed with water and dried by hot air to obtain a one-side zinc-plated steel sheet, one side of which was plated with a uniform zinc layer in an amount of 150 g/m$^2$ and another side of which was a beautiful cold rolled steel sheet surface itself.

Further, the composition of the anti-plating agent was varied, and the same experiments as described above were effected.

Table 1 shows the composition of the anti-plating agent and the anti-plating property and peeling property of the resulting anti-plating film. Experiment Nos. 1–13 in Table 1 are experiments using an anti-plating agent having the effective composition range defined in the present invention and shown in the FIGURE. The resulting anti-plating film is excellent in the anti-plating property and peeling property. Accordingly, a complete one-side zinc-plated steel sheet was obtained. While, Experiment Nos. 14–25 in Table 1 are comparative experiments using an anti-plating agent having a composition outside the effective composition range shown in the FIGURE, that is, outside the scope of the present invention. The resulting anti-plating film in Experiment Nos. 14–25 is noticeably poor in the anti-plating property and peeling property. Accordingly, in Experiment Nos. 14–25, complete one-side zinc-plated steel sheets were not obtained.

Table 1-(a)

| Experiment No. | Composition of anti-plating agent: Compounding recipe | Mole Ratio: $Na_2O$ | $SiO_2$ | $B_2O_3$ | MgO | Anti-plating property of anit-plating film | Peeling property of anti-plating film: Repeated bending | Water quenching |
|---|---|---|---|---|---|---|---|---|
| 1 (Present invention) | $Na_2O{\cdot}2SiO_2{\cdot}8.3H_2O$ 80g, $H_3BO_3$ 62g, MgO 100g, NaOH 43g | 1.63 | 1 | 1.04 | 5.17 | ◎ | ◎ | ◎ |
| 2 (") | $Na_2O{\cdot}2SiO_2{\cdot}8.3H_2O$ 80g, $H_3BO_3$ 55g, $Mg(OH)_2$ 70g NaOH 30g | 1.30 | 1 | 0.94 | 2.50 | ◎ | ◎ | ◎ |
| 3 (") | $Na_2O{\cdot}3.2SiO_2{\cdot}23H_2O$ 80g, $H_3BO_3$ 80g, MgO 90g, NaOH 50g | 1.97 | 1 | 1.65 | 3.92 | ◎ | ◎ | ◎ |
| 4 (") | $Li_2O{\cdot}2SiO_2{\cdot}8H_2O$ 71g, $H_3BO_3$ 62g, MgO 100g, LiOH 26g | ($Li_2O$) 1.65 | 1 | 1.04 | 5.17 | ◎ | ◎ | ◎ |
| 5 (") | $K_2O{\cdot}2SiO_2{\cdot}9H_2O$ 91g, $H_3BO_3$ 62g, MgO 100g, KOH 60g | ($K_2O$) 1.51 | 1 | 1.02 | 5.06 | ◎ | ◎ | ◎ |

Table 1-(a)-continued

| Experiment No. | Composition of anti-plating agent: Compounding recipe | Mole Ratio $Na_2O$ | $SiO_2$ | $B_2O_3$ | MgO | Anti-plating property of anit-plating film | Peeling property of anti-plating film: Repeated bending | Water quenching |
|---|---|---|---|---|---|---|---|---|
| 6 (") | $Na_2O \cdot 2SiO_2 \cdot 8.3H_2O$ 80g, $B_2O_3$ 35g, MgO 100g, NaOH 43g | 1.63 | 1 | 1.04 | 5.17 | ◎ | ◎ | ◎ |
| 7 (") | $Na_2O \cdot 3.2SiO_2 \cdot 23H_2O$ 80g, $Na_2B_4O_7 \cdot 10H_2O$ 96g, MgO 80g, NaOH 30g | 1.96 | 1 | 1.32 | 5.22 | ◎ | ◎ | ◎ |

Table 1-(b)

| Experiment No. | Composition of anti-plating agent: Compound recipe | Mole ratio $Na_2O$ | $SiO_2$ | $B_2O_3$ | MgO | Anti-plating property of anti-plating film | Peeling property of anti-plating film: Repeated bending | Water quenching |
|---|---|---|---|---|---|---|---|---|
| 8 (Present invention) | $Na_2O \cdot 2SiO_2 \cdot 8.3H_2O$ 80g, $H_3BO_3$ 30g, MgO 100g, NaOH 43g | 1.63 | 1 | 0.51 | 5.17 | ◎ | ◎ | O |
| 9 (") | $Na_2O \cdot 2SiO$ hd $2 \cdot 8.3H_2O$ 80g, $H_3BO_3$ 40g, MgO 33g, NaOH 25g | 1.16 | 1 | 0.68 | 1.17 | O | ◎ | O |
| 10 (") | $Na_2O \cdot 2SiO_2 \cdot 8.3H_2O$ 80g, $H_3BO_3$ 62g, MgO 100g, NaOH 7g | 0.69 | 1 | 1.04 | 5.17 | ◎ | ◎ | O |
| 11 (") | $Na_2O \cdot 2SiO_2 \cdot 8.3H_2O$ 80g, $H_3BO_3$ 370g, MgO 100g, NaOH 100g | 3.10 | 1 | 6.24 | 5.17 | O | O | Δ |
| 12 (") | $Na_2O \cdot 2SiO_2 \cdot 8.3H_2O$ 80g, $H_3BO_3$ 62g, MgO 350g, NaOH 43g | 1.63 | 1 | 1.04 | 17.9 | O | O | Δ |
| 13 (") | $Na_2O \cdot 2SiO_2 \cdot 8.3H_2O$ 80g, $H_3BO_3$ 300g, MgO 100g, NaOH 250g | 7.02 | 1 | 2.43 | 5.17 | ◎ | O | Δ |

Table 1-(c)

| Experiment No. | Composition of anti-plating agent: Compounding recipe | Mole ratio $Na_2O$ | $SiO_2$ | $B_2O_3$ | MgO | Anti-plating property of anti-plating film | Peeling property of anti-plating film: Repeated bending | Water quenching |
|---|---|---|---|---|---|---|---|---|
| 14 (Outside the present invention) | $Na_2O \cdot 2SiO_2 \cdot 8.3H_2O$ 80g, $H_3BO_3$ 62g, MgO 100g | 0.50 | 1 | 1.04 | 5.17 | O | × | × |
| 15 (") | $Na_2O \cdot 2SiO_2 \cdot 8.3H_2O$ 80g, MgO 100g, NaOH 43g | 1.63 | 1 | O | 5.17 | × | × | × |
| 16 (") | $Na_2O \cdot 2SiO_2 \cdot 8.3H_2O$ 80g, $H_3BO_3$ 62g, NaOH 43g | 1.63 | 1 | 1.04 | 0 | × | × | × |
| 17 (") | $Na_2O \cdot 2SiO_2 \cdot 8.3H_2O$ 80g, MgO 100g | 0.5 | 1 | 0 | 5.17 | × | × | × |
| 18 (") | $Na_2O \cdot 2SiO_2 \cdot 8.3H_2O$ 80g, $H_3BO_3$ 62g | 0.5 | 1 | 1.04 | 0 | × | × | × |
| 19 (") | $H_3BO_3$ 62g, MgO 100g, NaOH 43g | 1.08 | 0 | 1 | 4.96 | Δ | × | × |

Table 1-(d)

| Experiment No. | Composition of anti-plating agent: Compounding recipe | Mole ratio $Na_2O$ | $SiO_2$ | $B_2O_3$ | MgO | Anti-plating property of anti-plating film | Peeling property of anti-plating film: Repeated bending | Water quenching |
|---|---|---|---|---|---|---|---|---|
| 20 (Outside the present invention | $H_3BO_3$ 62g, MgO 100g | 0 | 0 | 1 | 4.96 | Δ | × | × |
| 21 (") | $H_3BO_3$ 62g, NaOH 43g | 1.07 | 0 | 1 | 0 | × | × | × |
| 22 (") | MgO 100g, NaOH 43g | 1 | 0 | 0 | 4.6 | × | × | × |
| 23 (") | $Na_2O \cdot 2SiO_2 \cdot 8.3H_2O$ | 0.50 | 1 | 0 | 0 | × | × | × |
| 24 (") | $H_3BO_3$ | 0 | 0 | 1 | 0 | × | × | × |
| 25 (") | MgO | 0 | 0 | 0 | 1 | Δ | × | × |

EXAMPLE 2

Eighty grams of water-glass ($Na_2O.2SiO_2.8.3H_2O$), 62 g of $H_3BO_3$, 100 g of MgO and 43 g of NaOH were dissolved or dispersed in a proper amount of water to prepare an aqueous slurry having a viscosity of 25 poises at 40° C and containing an anti-plating agent having a composition of $Na_2O:SiO_2:B_2O_3:MgO = 1.63:1:1.04:5.17$ (in mole ratio).

The aqueous slurry was uniformly coated to one side of a cold rolled common steel sheet having a thickness of 0.8 mm, which had previously been degreased by alkali, by means of a roll coater in an amount that the weight of the slurry after dried was about 40 g/m$^2$. After the coating, the steel sheet was heated up to 720° C at a temperature rising rate of 30° C/sec under nitrogen atmosphere, annealed at 720° C for 1 minute under 90% $N_2$ + 10% $H_2$ atmosphere, and successively dipped in a molten aluminum-containing plating bath kept at 700° C for 5 seconds. After the plating, the steel sheet was brought up from the bath, cooled in air to about 300° C and successively quenched by dipping it in water kept at 25° C.

As the result of the above treatment, one-side of the steel sheet was plated with aluminum, and another side thereof, which had been coated with the anti-plating agent prior to the plating, was not at all plated. Further, the film of the anti-plating agent was already peeled off completely. Then, the non-plated side of the steel sheet was finally polished by means of a Scotch bright roll, and then the steel sheet was washed with water and dried by hot air to obtain a complete one-side aluminum-plated steel sheet.

EXAMPLE 3

Eighty grams of water-glass ($Na_2O.2SiO_2.8.3H_2O$), 55 g of $H_3BO_3$, 70 g of $Mg(OH)_2$ and 30 g of NaOH were dissolved or dispersed in a proper amount of water to prepare an aqueous slurry having a viscosity of 20 poises at 40° C and containing an anti-plating agent having a composition of $Na_2O:SiO_2:B_2O_3:MgO = 1.30:1:0.94:2.50$ (in mole ratio).

The aqueous slurry was uniformly coated on one side of a cold rolled common steel sheet having a thickness of 0.8 mm, which had previously been fully degreased by alkali, by means of a roll coater in an amount that the weight of the slurry after dried was 60 g/m$^2$. After the coating, the steel sheet was heated up to 690° C at a temperature rising rate of 30° C/sec under nitrogen atmosphere, annealed at 690° C for 20 seconds under 90% $N_2$ + 10% $H_2$ atmosphere, and successively dipped in a molten Zn-Al alloy-containing plating bath having a composition of 45% Zn – 55% Al and kept at 650° C for 3 seconds. After the plating, the steel sheet was brought up from the bath, left to stand in air to be cooled to about 50° C, and successively passed through a leveller having a diameter of 100 mm.

As the result of the above treatment, one side of the steel sheet was plated with the Zn-Al alloy, and another side thereof, which had been coated with the anti-plating agent prior to the plating, was prevented from being plated. Further, the film of the anti-plating agent was already peeled off in a percentage of peeled area of 100%. The non-plated steel sheet surface was finally polished by means of a Scotch bright roll, and then the steel sheet was washed with water and dried by hot air to obtain a complete one-side Zn-Al alloy-coated steel sheet.

What is claimed is:

1. A method of producing one-side plated steel sheets or strips, comprising coating an aqueous slurry of an anti-plating agent, the amount of which is in the range of 20–150 g/m$^2$ in dry weight, and which forms after heating and dehydration a compound having a chemical composition represented by the formula of $$pM_2O.qSiO_2.rB_2O_3.sMgO$$

wherein M represents an alkali metal and *p, q, r* and *s* represent the numbers of moles of $M_2O$, $SiO_2$, $B_2O_3$, and MgO respectively, and the ratio of *p:q:r:s* is (0.5–9.0):1:(0.1–7.2):(1.0–34.5), on one side of a steel sheet or strip; heating the steel sheet or strip to form a film thereon; and then dipping the steel sheet or strip in a plating bath containing at least one member of the group consisting of molten zinc, aluminum, and zinc-aluminum alloy, to plate only that side of the steel sheet or strip which is not coated with said film.

2. A method according to claim 1, wherein the mole ratio of $M_2O:SiO_2:B_2O_3:MgO$ is (0.65–4.5):1:(0.1–5.0):(1.5–15).

3. A method according to claim 1, wherein the mole ratio of $M_2O:SiO_2:B_2O_3:MgO$ is (1.0–3.5):1:(0.8–2.7):(2.0–11.5).

4. A method according to claim 1, wherein said aqueous slurry of an anti-plating agent is prepared by dissolving or dispersing in water (A) at least one of magnesia (MgO) and magnesium hydroxide ($Mg(OH)_2$), (B) alkali silicate ($M_2O.nSiO_2.mH_2O$, wherein M represents an alkali metal and N represents a numeral of 0.5–4 and *m* represents the number of bonding water), (C) at least one of boric acid ($H_3BO_3$), boric anhydride ($B_2O_3$) and sodium borate ($Na_2B_4O_7$), and (D) an alkali (MOH, wherein M represents an alkali metal).

5. A method according to claim 1, wherein the coating slurry is dried at a temperature of not higher than 200° C and then the coated steel sheet or strip is heated at a temperature of not lower than the recrystallization temperature of the steel sheet or strip.

6. A method according to claim 1, wherein the coating film is peeled off by water-quenching.

7. A method according to claim 1, wherein the coating film is peeled off by repeated bendings by means of a roll.

8. A method of producing one-side plated steel sheets or strips, comprising coating an aqueous slurry of an anti-plating agent, which is prepared by dissolving or dispersing four components of magnesia (MgO), alkali silicate ($M_2O.nSiO_2.mH_2O$, wherein M represents an alkali metal), boric acid ($H_3BO_3$) and an alkali (MOH, wherein M represents an alkali metal) in a proper amount of water, on one side of a steel sheet or strip; drying the coating slurry to form a film thereon by heating, the amount of the coating slurry to be coated on the steel sheet or strip being in the range of 20–150 g/m$^2$ after the coating slurry is heated; and dipping the steel sheet or strip in a plating bath containing at least one member of the group consisting of molten zinc, aluminum, and zinc-aluminum alloy, to plate only that side of the steel sheet or strip which is not coated with the film.

* * * * *